US011371533B2

(12) United States Patent
Zhong et al.

(10) Patent No.: US 11,371,533 B2
(45) Date of Patent: Jun. 28, 2022

(54) BLADE ADJUSTMENT MECHANISM AND AIR CIRCULATOR

(71) Applicants: GD MIDEA ENVIRONMENT APPLIANCES MFG CO., LTD., Zhongshan (CN); MIDEA GROUP CO., LTD., Foshan (CN)

(72) Inventors: Qizhen Zhong, Zhongshan (CN); Zhong Yang, Zhongshan (CN)

(73) Assignees: GD MIDEA ENVIRONMENT APPLIANCES MFG. CO., LTD., Zhongshan (CN); MIDEA GROUP CO., LTD., Foshan (CN)

( * ) Notice: Subject to any disclaimer, the term of this patent is extended or adjusted under 35 U.S.C. 154(b) by 53 days.

(21) Appl. No.: 17/098,136

(22) Filed: Nov. 13, 2020

(65) Prior Publication Data

US 2021/0062825 A1 Mar. 4, 2021

Related U.S. Application Data

(63) Continuation of application No. PCT/CN2018/123811, filed on Dec. 26, 2018.

(30) Foreign Application Priority Data

May 16, 2018 (CN) ..... 201810478434.0

(51) Int. Cl.
*F04D 29/46* (2006.01)
*F04D 25/08* (2006.01)
*F04D 29/44* (2006.01)

(52) U.S. Cl.
CPC ..... *F04D 29/462* (2013.01); *F04D 25/08* (2013.01); *F04D 29/444* (2013.01)

(58) Field of Classification Search
CPC ..... F04D 29/462; F04D 25/08; F04D 29/444
See application file for complete search history.

(56) References Cited

U.S. PATENT DOCUMENTS 4,659,013 A * 4/1987 Ledebuhr ..... B05B 3/105 239/166
4,662,819 A * 5/1987 Lakowske ..... F04D 29/287 416/186 A (Continued)

FOREIGN PATENT DOCUMENTS

CN 202973460 U 6/2013
CN 106194843 A 12/2016

(Continued)

OTHER PUBLICATIONS

JP-2005003289-A English (Year: 2005).*

(Continued)

*Primary Examiner* — Shafiq Mian
(74) *Attorney, Agent, or Firm* — Morgan, Lewis & Bockius LLP

(57) ABSTRACT

A blade adjustment mechanism and an air circulator. The air circulator includes a housing defining an air outlet, and the air outlet includes an air inlet side and an air outlet side. The blade adjustment mechanism includes: a fixing bracket, fixedly connected with the housing; at least two wind guide assemblies, spaced apart from each other and partially extending into the air outlet, rotationally connected with the fixing bracket; at least two first connecting rods, rotationally connected with the at least two wind guide assemblies located, extension lines of the at least two first connecting rods along length directions of the at least two first connecting rods being configured to intersect; and a second connecting rod, fixedly connected with an end of each of the at least two first connecting rod.

20 Claims, 4 Drawing Sheets

(56) References Cited

U.S. PATENT DOCUMENTS

| | | | | |
|---|---|---|---|---|
| 5,299,978 | A | 4/1994 | Dennis et al. | |
| 6,454,528 | B2 * | 9/2002 | McCabe | F03D 9/28 454/351 |
| 8,177,484 | B2 * | 5/2012 | Haraguchi | F04D 29/283 416/241 A |
| 2002/0094774 | A1 | 7/2002 | Demerath | |
| 2012/0263573 | A1 * | 10/2012 | Tadokoro | F04D 29/283 415/53.1 |
| 2012/0315135 | A1 * | 12/2012 | Sato | F04D 29/281 415/204 |
| 2015/0091303 | A1 * | 4/2015 | Lee | F03D 3/068 290/53 |

FOREIGN PATENT DOCUMENTS

| | | | |
|---|---|---|---|
| CN | 107250684 | A | 10/2017 |
| CN | 107300251 | A | 10/2017 |
| CN | 107640115 | A | 1/2018 |
| CN | 206890777 | U | 1/2018 |
| CN | 107757348 | A | 3/2018 |
| CN | 108708876 | A | 10/2018 |
| FR | 2699870 | B1 | 2/1995 |
| JP | 11141945 | A | 5/1999 |
| JP | 2005003289 | A * | 1/2005 |
| JP | 2005003289 | A | 1/2005 |
| KR | 20120001882 | U | 3/2012 |
| WO | WO 2016141252 | A1 | 9/2016 |

OTHER PUBLICATIONS

Midea Environment Appliances MFG Co., Ltd., et al., Supplementary European Search Report, dated Sep. 6, 2021, 9 pgs.

Midea Group Co Ltd, International Search Report and Written Opinion, PCT/CN2018/123811, dated Mar. 11, 2019, 16 pgs.

GD Midea Environment Appliances Mfg. Co. Ltd., Midea Group Co Ltd, First Office Action, CN201810478434.0, dated Jul. 2, 2019, 19 pgs.

Guangdong Midea Environment Appliances Mfg. Co. Ltd., Midea Group Co Ltd, Second Office Action, CN201810478434.0, dated Feb. 3, 2020, 21 pgs.

GD Midea Environment Appliances Mfg. Co. Ltd., Midea Group Co Ltd, Third Office Action, CN201810478434.0, dated Jul. 24, 2020, 22 pgs.

GD Midea Environment Appliances Mfg. Co. Ltd., Midea Group Co Ltd, Rejection Decision, CN201810478434.0, dated Dec. 28, 2020, 18 pgs.

* cited by examiner

BLADE ADJUSTMENT MECHANISM AND AIR CIRCULATOR

CROSS-REFERENCE TO RELATED APPLICATIONS

This application is a continuation of PCT International Application PCT/CN2018/123811, filed on Dec. 26, 2018, entitled "Blade Adjustment Mechanism and Air Circulator," which claims the benefit of and priority to Chinese Patent Application 201810478434.0, filed on May 16, 2018, entitled "Blade Adjustment Mechanism and Air Circulator," the entirety of which are hereby incorporated herein by reference.

FIELD

This application relates to the technical field of air circulators, in particular to a blade adjustment mechanism and an air circulator having the blade adjustment mechanism.

BACKGROUND

Tower fans are also known as convection fans. The housing of the tower fan generally defines an air inlet and an air outlet. A cross-flow fan is installed inside the housing. The cross-flow fan draws air from the air inlet, and the cross-flow fan rotates to create wind pressure and generate centrifugal wind force, then the wind force is conducted through the internal wind guide wall, and then the air is blown out from the air outlet. Because the cross-flow wind wheel is generally cylindrical, a three-dimensional airflow wall may be obtained by using a tower fan. Guide blades and the air outlet of the existing tower fan are fixed to each other, and the whole machine or air duct can only be moved within a certain angle through the shaking head mechanism, but the wind at the air outlet cannot be blown concentratedly or divergingly, and the user experience is poor.

SUMMARY

The main object of this application is to provide a blade adjustment mechanism, which aims to make the air outlet have the functions of centralized blowing and divergent blowing, and improve the user experience.

In order to achieve the above object, the blade adjustment mechanism provided in this application is applied to an air circulator including a housing, and the housing defines an air outlet having an air inlet side and an air outlet side. The blade adjustment mechanism includes:

a fixing bracket, fixedly connected with the housing;

at least two wind guide assemblies, spaced apart from each other and partially extending into the air outlet, one of the at least two wind guide assemblies including two opposite side edges, a side edge of the one of the at least two wind guide assemblies located at the air outlet side being rotationally connected with the fixing bracket;

at least two first connecting rods, an end of one of the at least two first connecting rods being rotationally connected with a side edge of the one of the at least two wind guide assemblies located at the air inlet side, extension lines of the at least two first connecting rods along length directions of the at least two first connecting rods being configured to intersect; and a second connecting rod, fixedly connected with an end of each of the at least two first connecting rods facing away from the at least two wind guide assemblies where the second connecting rod is driven to move closer to or farther away from the at least two wind guide assemblies to drive the at least two first connecting rods to drive the at least two wind guide assemblies to rotate around the fixing bracket; parts of the at least two wind guide assemblies extending into the air outlet are opened or gathered relative to the air outlet to make the air outlet blow divergingly or concentratedly.

Optionally, one of the at least two wind guide assemblies includes at least one wind deflector, one of a side edge of the at least one wind deflector located at the air outlet side and the fixing bracket defining a connection hole, the other one of the side edge of the at least one wind deflector located at the air outlet side and the fixing bracket including a rotation post, the rotation post being inserted into the connection hole to rotationally connect the at least one wind deflector and the fixing bracket.

Optionally, the at least one wind deflector includes a blade extending into the air outlet, a side edge of the blade at the air inlet side being rotationally connected with one of the at least two first connecting rods, the blade being provided with the rotation post at an end;

where the connection hole is defined on the fixing bracket; the second connecting rod is driven to move closer to or farther away from the at least one wind deflector to drive the at least two first connecting rods to drive the blade to rotate around a central axis of the connection hole; thereby to drive the blade to be opened or gathered relative to the air outlet to make the air outlet blow divergingly or concentratedly.

Optionally, one of a side end of the blade at the air inlet side and one of the at least two first connecting rods is provided with a limit post, the other one of the side end of the blade at the air inlet side and the one of the at least two first connecting rods defines a locking hole, the limit post being inserted into the locking hole to rotationally connect the one of the at least two first connecting rods and the blade.

Optionally, the housing includes a partition plate provided at the air outlet and partitioning the at least two wind guide assemblies, and one of the at least two wind guide assemblies includes at least two wind deflectors spaced apart from each other;

the blade adjustment mechanism further includes a third connecting rod, one side of the third connecting rod being rotationally connected with one of the at least two first connecting rods, the other side of the third connecting rod defining at least two limit holes, the limit post being inserted and fixed to one of the at least two limit holes.

Optionally, each of the at least two wind guide assemblies includes a plurality of latches arranged at intervals on a side edge of the air inlet side of the air outlet, and the fixing bracket includes a plurality of fixing plates arranged at intervals along an extension direction of the air outlet;

each of the plurality of fixing plates defines a plurality of limit slots arranged at intervals, and each of the plurality of latches is configured to extend into one of the plurality of limit slots.

Optionally, the second connecting rod defines a receiving part, and the blade adjustment mechanism further includes an eccentric wheel assembly, including a wheel, movably received in the receiving part and abutted against a side wall of the receiving part; and an adjustment rod, connected to the wheel and extending from a surface of the wheel facing away from the receiving part;

where the adjustment rod is driven to rotate to drive the second connecting rod to move closer to or farther away from the at least two wind guide assemblies.

Optionally, the eccentric wheel assembly further includes a rod cap sleeved and fixed to an end of the adjustment rod facing away from the wheel.

Optionally, one of the second connecting rod and the fixing bracket defines a guide limit slot, the other one of the second connecting rod and the fixing bracket including a limit projection, the limit projection is configured to extend into the guide limit slot to limit movement of the second connecting rod relative to the fixing bracket.

This application further provides an air circulator including a housing, a cross-flow wind wheel and a blade adjustment mechanism adjacent to the cross-flow wind wheel; the housing defines an air outlet including an air inlet side and an air outlet side; the cross-flow wind wheel is fixedly connected with the housing; the blade adjustment mechanism includes:

a fixing bracket, fixedly connected with the housing;

at least two wind guide assemblies, spaced apart from each other and partially extending into the air outlet, one of the at least two wind guide assemblies including two opposite side edges, a side edge of the one of the at least two wind guide assemblies located at the air outlet side being rotationally connected with the fixing bracket;

at least two first connecting rods, an end of one of the at least two first connecting rods being rotationally connected with a side edge of the one of the at least two wind guide assemblies located at the air inlet side, extension lines of the at least two first connecting rods along length directions of the at least two first connecting rods being configured to intersect; and a second connecting rod, fixedly connected with an end of each of the at least two first connecting rods facing away from the at least two wind guide assemblies;

where the second connecting rod is driven to move closer to or farther away from the at least two wind guide assemblies to drive the at least two first connecting rods to drive the at least two wind guide assemblies to rotate around the fixing bracket, parts of the at least two wind guide assemblies extending into the air outlet being opened or gathered relative to the air outlet to make the air outlet blow divergingly or concentratedly.

According to the technical solution of this application, the housing defines an air outlet, and a fixing bracket, at least two wind guide assemblies, at least two first connecting rods and a second connecting rod are provided on the housing. A side edge of the wind guide assembly at the air outlet side is rotationally connected with the fixing bracket. One end of the first connecting rod is rotationally connected with a side edge of the wind guide assembly at the air inlet side, and the other end of the first connecting rod is rotationally connected with the second connecting rod. When the air outlet needs to blow divergingly, the second connecting rod is driven to move closer to the air guide assemblies, so that the first connecting rods may drive the air guide assemblies to rotate around the fixing bracket, and then drive the parts of the air guide assemblies extending into the air outlet to diverge relative to the air outlet, so that the air outlet may blow divergingly. When the air outlet needs to blow concentratedly, the second connecting rod is driven to move farther away from the wind guide assemblies, so that the first connecting rods may drive the wind guide assemblies to rotate around the fixing bracket, and then drive the parts of the wind guide assemblies extending into the air outlet to gather relative to the air outlet, so that the air outlet may blow concentratedly. In this way, according to the technical solution of this application, the air outlet may have the functions of centralized blowing and divergent blowing, thereby improving the user experience.

BRIEF DESCRIPTION OF THE DRAWINGS

In order to more clearly explain the embodiments of this application or the technical solutions in the prior art, the following will briefly introduce the drawings required in the embodiments or the description of the prior art. Obviously, the drawings in the following description are only some embodiments of this application. For those of ordinary skill in the art, without paying any creative work, other drawings can be obtained according to the structures shown in these drawings.

DESCRIPTION OF REFERENCE NUMERALS

TABLE 1

Figure 1:
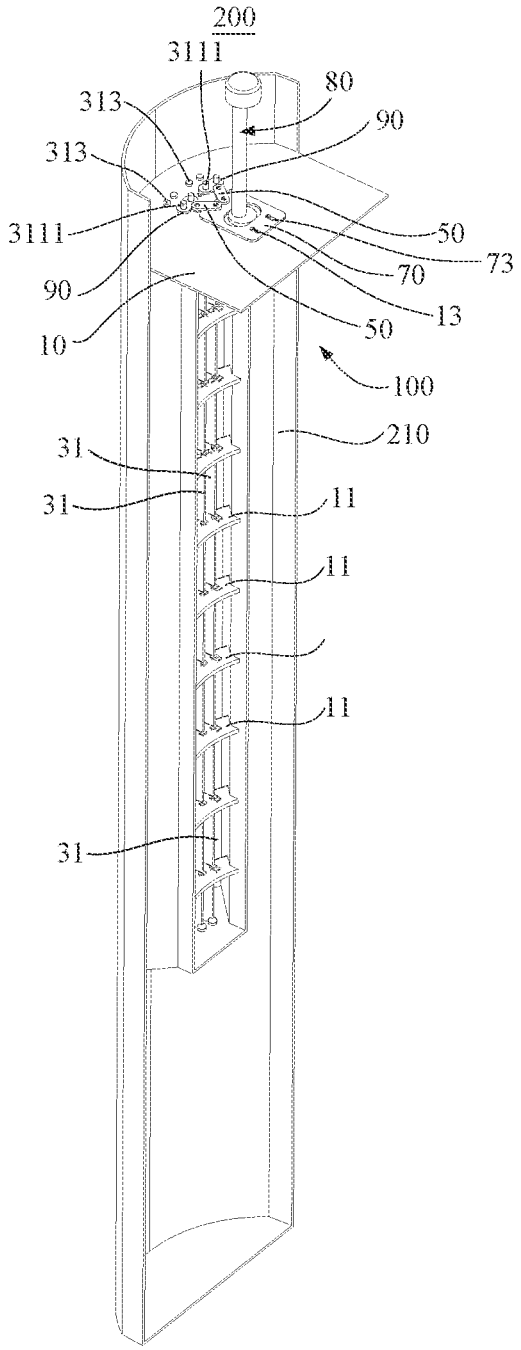
FIG. 1 is a schematic structural diagram of a blade adjustment mechanism of an air circulator according to an embodiment of this application.

| No. | Name |
|---|---|
| 100 | Blade adjustment mechanism |
| 10 | Fixing bracket |
| 11 | Fixing plate |
| 111 | Limit slot |
| 13 | Limit projection |
| 15 | Rotation hole |
| 20 | Partition plate |
| 30 | Wind guide assembly |
| 31 | Wind deflector |
| 311 | Blade |
| 3111 | Limit post |
| 313 | Rotation post |
| 315 | Latch |
| 50 | First connecting rod |
| 51 | Locking hole |
| 53 | Insertion hole |
| 70 | Second connecting rod |
| 71 | Receiving part |
| 73 | Guide limit slot |
| 80 | Eccentric wheel assembly |
| 81 | Wheel |
| 83 | Adjustment rod |
| 85 | Rod cap |
| 90 | Third connecting rod |
| 91 | Limit hole |
| 93 | Post |
| 200 | Air circulator |
| 210 | Housing |
| 211 | Air outlet |

The implementation, functional characteristics and advantages of this application will be further described in conjunction with the embodiments and with reference to the drawings.

DETAILED DESCRIPTION OF THE EMBODIMENTS

The technical solutions in the embodiments of this application will be described clearly and completely in conjunction with the drawings in the embodiments of this application. Obviously, the described embodiments are only a part of the embodiments of this application, but not all the embodiments. Based on the embodiments in this application, all other embodiments obtained by those of ordinary skill in the art without making creative efforts fall within the protection scope of this application.

It should be noted that all directional indicators (such as up, down, left, right, front, back . . . ) in the embodiments of this application are only used to explain the relative positional relationship, movement conditions, etc. among the components in a specific posture (as shown in the drawings), if the specific posture changes, the directional indicator also changes accordingly.

In addition, the descriptions related to "first", "second", etc. in this application are for descriptive purposes only, and cannot be understood as indicating or implying their relative importance or implicitly indicating the number of indicated technical features. Thus, the features defined as "first" and "second" may include at least one of the features either explicitly or implicitly. In addition, the technical solutions between the various embodiments can be combined with each other, but they must be based on the ability of those skilled in the art to realize. When the combination of technical solutions conflicts with each other or cannot be realized, it should be considered that the combination of such technical solutions does not exist, nor within the scope of protection required by this application.

This application provides a blade adjustment mechanism 100.

Referring to FIGS. 1 to 4, the blade adjustment mechanism 100 provided in the technical solution of this application is applied to an air circulator 200. The air circulator 200 includes a housing 210 defining an air outlet 211. The air outlet 211 has an air inlet side and an air outlet side. The blade adjustment mechanism 100 includes:

a fixing bracket 10, fixedly connected with the housing 210;

at least two wind guide assemblies 30, spaced apart from each other and partially extending into the air outlet 211, one of the at least two wind guide assemblies 30 including two opposite side edges, a side edge of the one of the at least two wind guide assemblies 30 located at the air outlet side being rotationally connected with the fixing bracket 10;

at least two first connecting rods 50, an end of one of the at least two first connecting rods 50 being rotationally connected with a side edge of the one of the at least two wind guide assemblies 30 located at the air inlet side, extension lines of the at least two first connecting rods 50 along length directions of the at least two first connecting rods 50 being configured to intersect; and a second connecting rod 70, fixedly connected with an end of each of the at least two first connecting rods 50 facing away from the at least two wind guide assemblies 30;

where the second connecting rod 70 is driven to move closer to or farther away from the at least two wind guide assemblies 30, so that the at least two first connecting rods 50 may drive the at least two wind guide assemblies 30 to rotate around the fixing bracket 10, and parts of the at least two wind guide assemblies 30 extending into the air outlet 211 are opened or gathered relative to the air outlet 211, so that the air outlet 211 may blow divergingly or concentratedly.

According to the technical solution of this application, the housing 210 defines an air outlet 211, and a fixing bracket 10, at least two wind guide assemblies 30, at least two first connecting rods 50 and a second connecting rod 70 are provided on the housing 210. A side edge of the wind guide assembly 30 at the air outlet side is rotationally connected with the fixing bracket 10. One end of the first connecting rod 50 is rotationally connected with a side edge of the wind guide assembly 30 at the air inlet side, and the other end of the first connecting rod 50 is rotationally connected with the second connecting rod 70. When the air outlet 211 needs to blow divergingly, the second connecting rod 70 is driven to move closer to the air guide assemblies 30, so that the first connecting rods 50 may drive the air guide assemblies 30 to rotate around the fixing bracket 10, and then drive the parts of the air guide assemblies 30 extending into the air outlet 211 to diverge relative to the air outlet 211, so that the air outlet 211 may blow divergingly. When the air outlet 211 needs to blow concentratedly, the second connecting rod 70 is driven to move farther away from the wind guide assemblies 30, so that the first connecting rods 50 may drive the wind guide assemblies 30 to rotate around the fixing bracket 10, and then drive the parts of the wind guide assemblies 30 extending into the air outlet 211 to gather relative to the air outlet 211, so that the air outlet 211 may blow concentratedly. In this way, according to the technical solution of this application, the air outlet 211 may have the functions of centralized blowing and divergent blowing, thereby improving the user experience.

In an embodiment of this application, the housing 210 is substantially cylindrical, and its material may be hard plastic or light alloy, as long as the housing 210 has a certain supporting function, and an installation space can be defined inside. It can be understood that some components of the air circulator 200 are installed in the installation space. The air outlet 211 is configured to communicate the installation space of the air circulator 200 with the external space. In this embodiment, the air outlet 211 is substantially fan-shaped, and the opening angle of the air outlet 211 may be set according to actual needs, and the shape of the air outlet 211 may be set according to the air outlet requirements of the air circulator 200.

In addition, the fixing bracket 10 is installed and fixed adjacent to the air outlet 211, so that it is convenient for connecting the fixing bracket 10 and the wind guide assemblies 30. It should be noted that the fixing bracket 10 may be formed integrally with the housing 210, or the fixing bracket 10 and the housing 210 may be detachably connected to each other. Specifically, the fixing bracket 10 and the housing 210 may be engaged by engaging members or fastened with fasteners to be fixed with each other. Certainly, the fixing bracket 10 and the housing 210 may also be fixed by a non-detachable connection manner. Specifically, fixing methods such as welding may be used, as long as they can make a better connection between the fixing bracket 10 and the housing 210.

It should be noted that, extension lines of the two first connecting rods 50 along length directions of the two first connecting rods 50 are configured to intersect. In this way, when the second connecting rod 70 is moved forward (closer to the wind guide assemblies 30) or backward (farther away from the wind guide assemblies 30), ends of the first connecting rods 50 facing away from the second connecting rod 70 may move relatively away or relatively close, thereby driving the wind guide assemblies 30 to rotate around the fixing bracket 10, so that the wind guide assemblies 30 may open or gather relative to the air outlet 211, so that the air outlet 211 may blow divergingly or concentratedly.

It can be understood that when the intersecting position of the extension lines of the two first connecting rods 50 extending along the length directions thereof changes, the effect of the second connecting rod 70 driving the first connecting rods 50 correspondingly changes, so that the effect of the air outlet 211 of concentrate blowing or divergent blowing is changed. Specifically, when the intersecting position is at the air inlet side, the second connecting rod 70 is driven to move closer to or farther away from the wind guide assemblies 30, so that the first connecting rods 50 may drive the wind guide assemblies 30 to rotate around the fixing bracket 10, and parts of the wind guide assemblies 30 extending into the air outlet 211 are opened or gathered relative to the air outlet 211, so that the air outlet 211 may blow divergingly or concentratedly. When the intersecting position is at the air outlet side, the second connecting rod 70 is driven to move closer to or farther away from the wind guide assemblies 30, so that the first connecting rods 50 may drive the wind guide assemblies 30 to rotate around the fixing bracket 10, and parts of the wind guide assemblies 30 extending into the air outlet 211 are gathered or opened relative to the air outlet 211, so that the air outlet 211 may blow concentratedly or divergingly.

Figure 2:
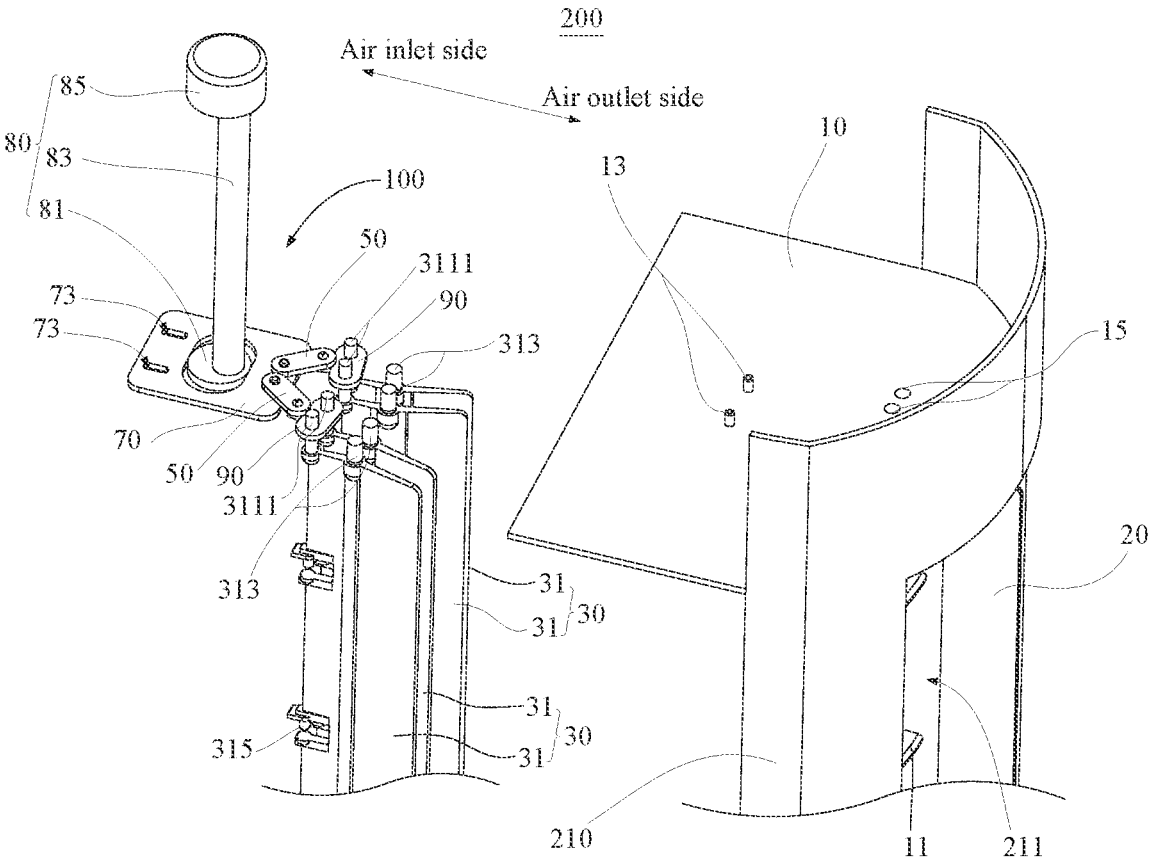
FIG. 2 is a partially exploded schematic diagram of the blade adjustment mechanism of the air circulator according to an embodiment of this application.

Referring to FIG. 2, in an embodiment of this application, one of the wind guide assemblies 30 includes at least one wind deflector 31. One of a side edge of the at least one wind deflector 31 located at the air outlet side and the fixing bracket 10 defines a connection hole, the other one of the side edge of the at least one wind deflector 31 located at the air outlet side and the fixing bracket 10 includes a rotation post 313. The rotation post 313 is inserted into the connection hole, so that the at least one wind deflector 31 and the fixing bracket 10 may be rotationally connected.

In this embodiment, the wind deflector 31 and the fixing bracket 10 are rotationally connected by means of the connection hole and the rotation post 313, so that the wind deflector 31 and the fixing bracket 10 are simple in structure and have a good rotation and connection function, thereby reducing production costs. Certainly, a fixed pair and a rotating pair may also be provided, and the fixed pair and the rotating pair are connected through balls or bearings to achieve rotation. The side edge of the wind deflector 31 at the air outlet side is rotationally connected, so that a better flow guiding effect may be achieved.

Figure 3:
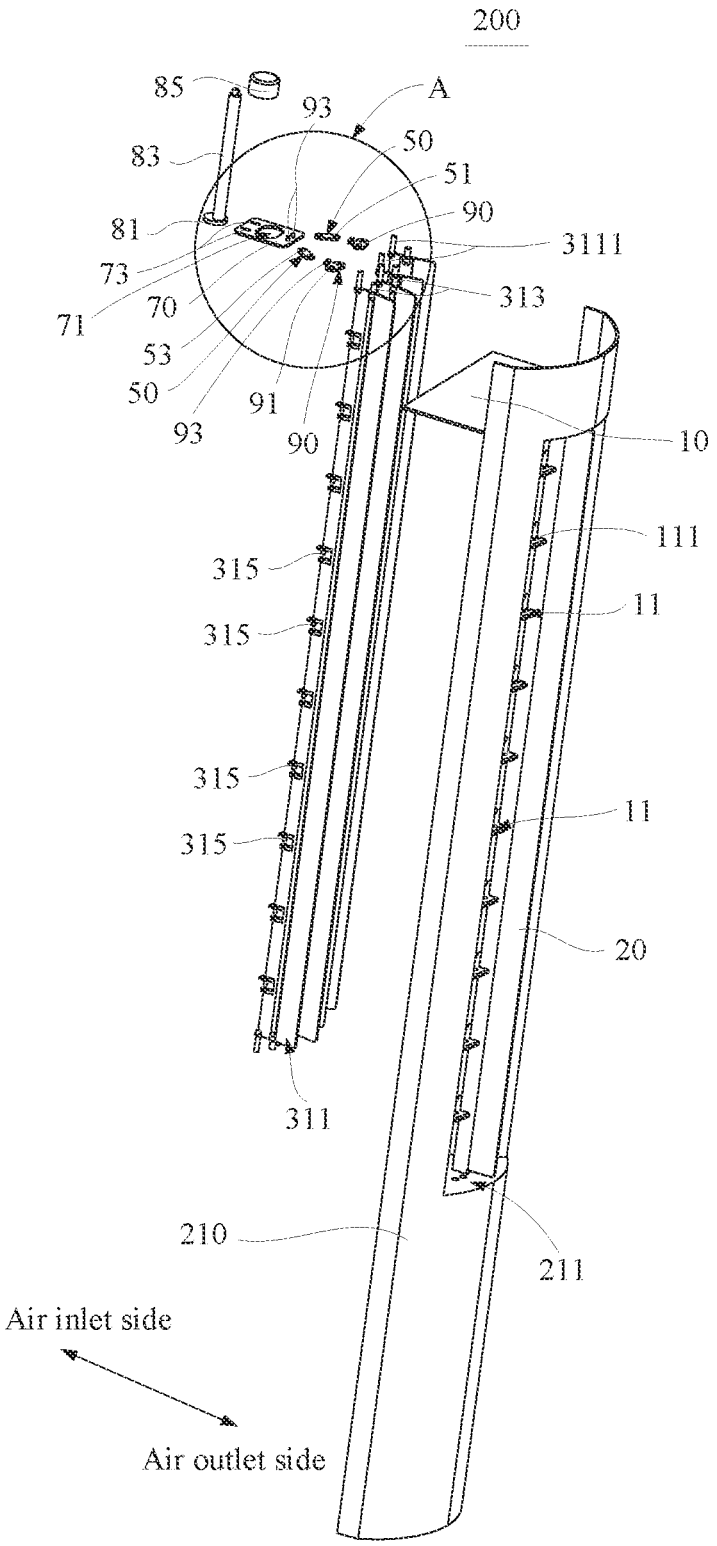
FIG. 3 is an exploded schematic diagram of the blade adjustment mechanism of the air circulator according to an embodiment of this application.

Referring to FIGS. 1 and 3, further, the wind deflector 31 includes blades 311 extending into the air outlet 211. A side edge of each blade 311 at the air inlet side is rotationally connected with one of the first connecting rods 50, and the rotation post 313 is provided at an end of each blade 311.

The connection hole is defined on the fixing bracket 10. The second connecting rod 70 is driven to move closer to or farther away from the wind deflector 31, so that the first connecting rods 50 may drive the blades 311 to rotate around a central axis of the connection hole. The blades 311 are opened or gathered relative to the air outlet 211, so that the air outlet 211 may blow divergingly or concentratedly.

Specifically, the rotation post 313 is located at a side edge of an air outlet side of each blade 311. In this way, it is convenient for the second connecting rod 70 to drive the first connecting rods 50, so that the first connecting rods 50 may drive the wind guide assemblies 30 to rotate, thereby achieving concentrate blowing and divergent blowing of the air outlet 211.

In an embodiment of this application, the blades 311 are accommodated in the air outlet 211, that is, the wind deflector 31 mainly gathers or disperses the airflow through the blades 311. It can be understood that the wind deflector 31 may have various cross-sectional shapes, such as an aerodynamic airfoil shape, a rectangular shape, a curved shape, etc., as long as it is convenient for the wind to exit. When the wind deflector 31 blows concentratedly, side surfaces of the blades 311 at the air outlet side may enclose an edge of the air outlet 211 toward the air inlet side, so that more air may be directed to a central opening, thereby achieving a better concentrated blowing effect. When the wind deflector 31 blows divergingly, side surfaces of the blades 311 at the air outlet side may block a gap between an inner side wall of the air outlet 211 and the blades 311, so that more air may be guided to the central opening, thereby achieving higher air flow rate, so as to have a better effect of diverging blowing (wide-angle blowing).

Figure 4:
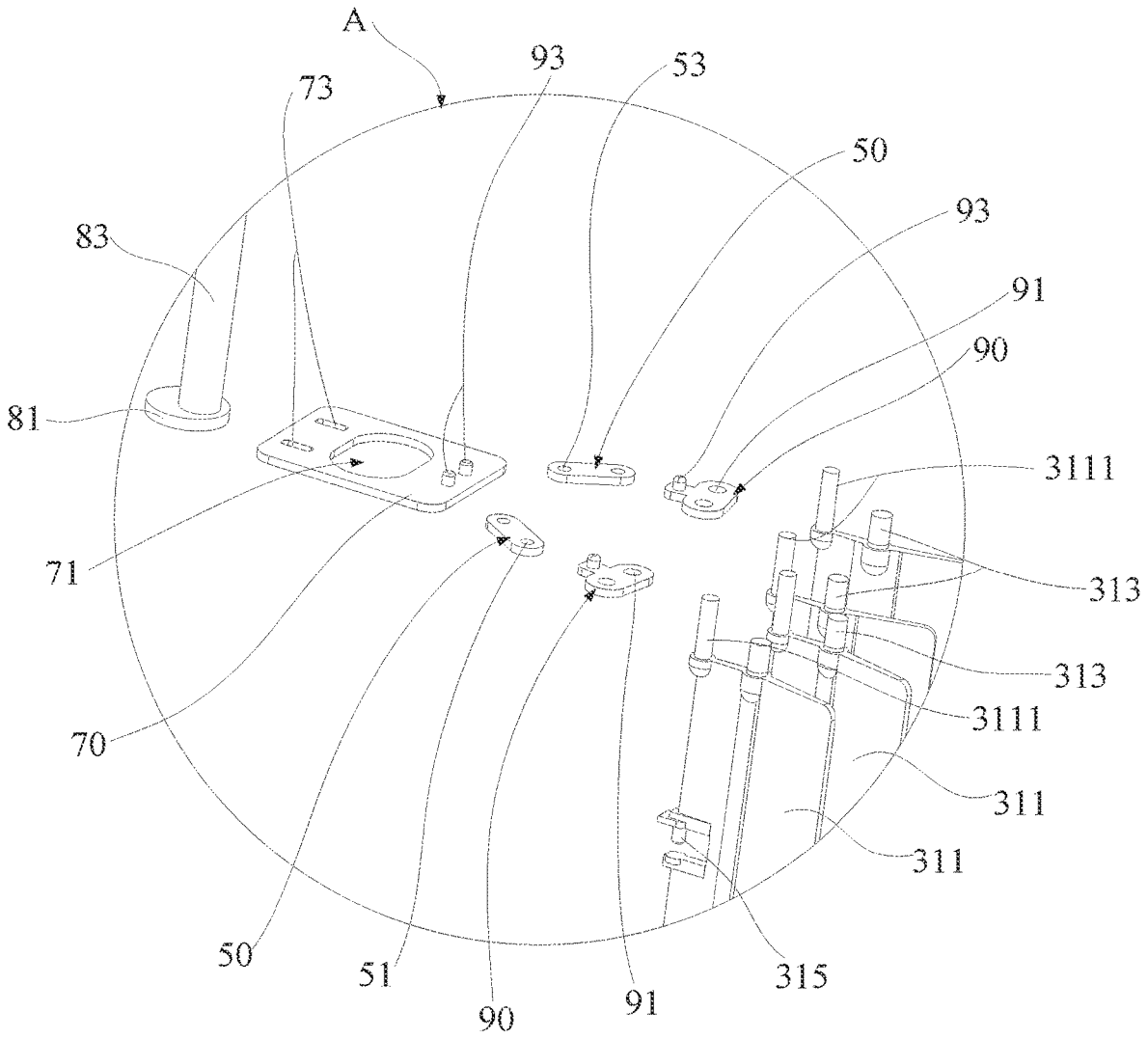
FIG. 4 is a partial view at A in FIG. 3.

Referring to FIGS. 2 to 4, in an embodiment of this application, one of a side end of the blade 311 at the air inlet side and the first connecting rod 50 is provided with a limit post 3111, the other one of the side end of the blade 311 at the air inlet side and the first connecting rod 50 defines a locking hole 51. The limit post 3111 is inserted into the locking hole 51, so that the first connecting rods 50 and the blades 311 may be rotationally connected. In this embodiment, the first connecting rods 50 are fixed with the wind deflectors 31 through the cooperation of the limit posts 3111 and the locking holes 51, so that the first connecting rods 50 may better drive the wind deflectors 31 to rotate. It can be understood that the limit post 3111 may be a polygonal or circular column, and a shape of the limit hole 91 is adapted to a shape of the limit post 3111.

Further, the housing 210 includes a partition plate 20 provided at the air outlet 211, and the partition plate 20 is configured to partition the two wind guide assemblies 30. Each wind guide assembly 30 includes at least two wind deflectors 31 spaced apart from each other.

The blade adjustment mechanism 100 further includes third connecting rods 90. One side of each third connecting rod 90 is rotationally connected with the first connecting rod 50, and the other side of each third connecting rod 90 defines at least two limit holes 91. One of the limit post 3111 is inserted and fixed to one of the limit holes 91.

It can be understood that the partition plate 20 guides the wind flowing out of the air outlet 211, so that the diffusion range of the wind is larger. It can be understood that one of the wind guide assemblies 30 may include a plurality of wind deflectors 31, which may make the wind guiding effect of the air outlet 211 better. In addition, when the plurality of wind deflectors 31 are driven by the adjusting member, rotation angles of the plurality of wind deflectors 31 should be consistent, so that the blowing airflows are parallel to each other and do not interfere with each other. Moreover, when one of the wind guide assemblies 30 includes a plurality of wind deflectors 31, third connecting rods 90 that are rotationally connected with the first connecting rods 50 are provided. A side of each third connecting rod 90 adjacent to the wind deflector 31 defines a plurality of limit holes 91, so that when the third connecting rods 90 moves, they may drive a plurality of wind deflectors 31 to move, so that a better effect of concentrate blowing and divergent blowing of the air outlet plate may be achieved. The position where the first connecting rod 50 connected with the third connecting rod 90 is located at a center of the third connecting rod 90. In this way, the rotation of the third connecting rod 90 driven by the first connecting rod 50 may be balanced, so that the wind deflectors 31 at the same side of the partition plate 20 may have a parallel air outlet angle to facilitate air outlet. Or, when the first connecting rod 50 is connected to another position of the third connecting rod 90, a distance between the rotation post 313 and the limit post 3111 may be changed accordingly, so that the wind deflectors 31 at the same side of the partition plate 20 may have a parallel air outlet angle to facilitate air outlet.

In this embodiment, the rotational connection between the first connecting rod 50 and the second connecting rod 70, and the first connecting rod 50 and the third connecting rod 90 are adopted the following method: one of the two is provided with a post 93, and the other one of the two defines an insertion hole 53, and the post 93 is inserted into the insertion hole 53 to realize the rotational connection between the two.

Further, each wind guide assembly 30 includes a plurality of latches 315 arranged at intervals on a side edge of the air inlet side of the air outlet 211. The fixing bracket 10 includes a plurality of fixing plates 11 arranged at intervals along an extension direction of the air outlet 211.

Each fixing plate 11 defines a plurality of limit slots 111 arranged at intervals, and each latch 315 is configured to extend into one of the limit slots 111.

The rotational connection of the wind deflectors 31 and the fixing bracket 10 may be more stable by providing a plurality of latches 315 and a plurality of limit slots 111. In this embodiment, the air outlet 211 is configured to extend in an up-down direction. It can be understood that the fixing plates 11 are arranged at intervals on the fixing brackets 10 in the up-down direction. This arrangement may further improve the rotational connection stability of the wind deflectors 31 and the fixing bracket 10, thereby improving the wind guiding effect of the wind deflectors 31 and improving effect of the concentrated blowing and divergent blowing of the air outlet 211. In this embodiment, the extension direction of the limit slot 111 is consistent with the rotation direction of the wind deflectors 31. Specifically, the extension direction of the limit slot 111 is set to an arc shape. In this way, the rotation of the wind deflectors 31 may be more convenient, thereby improving the wind guiding effect of the wind deflectors 31, and improving the effect of concentrate blowing and divergent blowing of the air outlet 211.

Referring to FIGS. 2 and 4, in an embodiment of this application, the second connecting rod 70 defines a receiving part 71. The blade adjustment mechanism 100 further includes an eccentric wheel assembly 80, which includes a wheel 81 and an adjustment rod connected to the wheel 81. The wheel 81 is movably received in the receiving part 71 and abutted against a side wall of the receiving part 71. The adjustment rod is configured to extend from a surface of the wheel 81 facing away from the receiving part 71.

The adjustment rod is driven to rotate. The wheel 81 is abutted against the side wall of the receiving part 71, and the second connecting rod 70 is driven to move closer to or farther away from the wind guide assemblies 30.

The receiving part 71 may be a sliding slot, a sliding hole, a sliding space, etc., as long as the wheel 81 may be easily moved in the receiving part 71, and a specific structure of the receiving part 71 may be set according to actual needs. Specifically, the wheel 81 of the eccentric wheel assembly 80 is substantially arranged in a disc shape. A side edge of the disc is abutted against the receiving part 71, and a bottom of the disc is abutted against a bottom of the receiving part 71. The disc further defines an axis. The adjustment rod 83 is configured to extend from a surface of the disc facing away from the bottom of the receiving part 71, and an axis of the adjustment rod 83 and the axis of the disc do not coincide with each other, thereby forming an eccentric setting to drive the adjustment rod 83 to rotate, so that a movement trajectory of the wheel 81 is non-circular, so as to drive the second connecting rod 70 to move forward (closer to the wind guide assemblies 30) or backward (farther away from the wind guide assemblies 30) to facilitate driving the second connecting rod 70, thereby facilitating the realization of concentrate blowing and divergent blowing.

Further, the eccentric wheel assembly 80 further includes a rod cap 85, and the rod cap 85 is sleeved and fixed to an end of the adjustment rod facing away from the wheel 81. The rod cap 85 is provided to facilitate rotating the adjustment rod 83 by the user. It can be understood that the housing 210 further defines a through hole. One end of the adjustment rod 83 is configured to extend out of the through hole, and the rod cap 85 is sleeved on an end of the adjustment rod 83 extending out of the through hole, so that the blade adjustment mechanism 100 may work better under the protection of the housing 210, which is convenient for users to use.

In an embodiment of this application, one of the second connecting rod 70 and the fixing bracket 10 defines a guide limit slot 73, and the other one of the second connecting rod 70 and the fixing bracket 10 includes a limit projection 13. The limit projection 13 is configured to extend into the guide limit slot 73 to limit movement of the second connecting rod 70 relative to the fixing bracket 10.

The guide limit slot 73 and the limit projection 13 are provided to fix the relative movement position of the second connecting rod 70 and the fixing bracket 10. Specifically, an extension direction of the guide limit slot 73 is a front-rear direction, so it is convenient for the second connecting rod 70 to drive the first connecting rods 50 at the shortest distance, thereby improving the response. Certainly, the setting direction of the guide limit slot 73 may also be set according to actual needs, as long as the second connecting rod 70 may better drive the first connecting rods 50. Moreover, two or more of the guide limit slots 73 may be provided. When a plurality of the guide limit slots 73 are provided, they may be left-right aligned or front-back aligned, as long as the second connecting rod 70 may better drive the first connecting rods 50.

It can be understood that a movement range of the second connecting rod 70 and a distance between the two wind deflectors 31 may affect a rotation angle range of the wind deflectors 31 of the blade adjustment mechanism 100. In this embodiment, the angle range of the wind deflectors 31 is 5 degrees to 45 degrees. In addition, a knob may be driven to rotate by providing a driving component, and the driving component may be controlled by a control circuit, so that it is convenient for users to use. Specifically, the driving component may be a synchronous motor or a stepper motor, as long as it is convenient to use. Moreover, the blade adjustment mechanism 100 may also be installed outside the installation space of the housing 210, as long as it is convenient for the user to use.

This application further provides an air circulator 200 including a housing 210, a cross-flow wind wheel and a blade adjustment mechanism 100 adjacent to the cross-flow wind wheel. The housing 210 defines an air outlet 211 including an air inlet side and an air outlet side. The cross-flow wind wheel is fixedly connected with the housing 210. The blade adjustment mechanism 100 includes:

a fixing bracket 10, fixedly connected with the housing 210;

at least two wind guide assemblies 30, spaced apart from each other and partially extending into the air outlet 211, one of the at least two wind guide assemblies 30 including two opposite side edges, a side edge of the one of the at least two wind guide assemblies 30 located at the air outlet side being rotationally connected with the fixing bracket 10;

at least two first connecting rods 50, an end of one of the at least two first connecting rods 50 being rotationally connected with a side edge of the one of the at least two wind guide assemblies 30 located at the air inlet side, extension lines of the at least two first connecting rods 50 along length directions of the at least two first connecting rods 50 being configured to intersect; and a second connecting rod 70, fixedly connected with an end of each of the at least two first connecting rods 50 facing away from the at least two wind guide assemblies 30;

where the second connecting rod 70 is driven to move closer to or farther away from the at least two wind guide assemblies 30, so that the at least two first connecting rods 50 may drive the at least two wind guide assemblies 30 to rotate around the fixing bracket 10, and parts of the at least two wind guide assemblies 30 extending into the air outlet 211 are opened or gathered relative to the air outlet 211, so that the air outlet 211 may blow divergingly or concentratedly. Since the air circulator 200 adopts all the technical solutions of all the above-mentioned embodiments, it has at least all the beneficial effects brought by the technical solutions of the above-mentioned embodiments, which will not be repeated here.

The above are only the preferred embodiments of this application, and therefore do not limit the patent scope of this application. Under the conception of this application, any equivalent structural transformation made by using the content of the description and drawings of this application, or direct/indirect application in other related technical fields are all included in the patent protection scope of this application.

What is claimed is:

1. A blade adjustment mechanism, for an air circulator, the air circulator comprising a housing defining an air outlet, the air outlet comprising an air inlet side and an air outlet side, wherein the blade adjustment mechanism comprises:

a fixing bracket, fixedly connected with the housing;

at least two wind guide assemblies, spaced apart from each other and partially extending into the air outlet, one of the at least two wind guide assemblies comprising two opposite side edges, a side edge of the one of the at least two wind guide assemblies located at the air outlet side being rotationally connected with the fixing bracket;

at least two first connecting rods, an end of one of the at least two first connecting rods being rotationally connected with a side edge of the one of the at least two wind guide assemblies located at the air inlet side, extension lines of the at least two first connecting rods along length directions of the at least two first connecting rods being configured to intersect; and a second connecting rod, fixedly connected with an end of each of the at least two first connecting rods facing away from the at least two wind guide assemblies;

wherein the second connecting rod is configured to be driven to move closer to or farther away from the at least two wind guide assemblies to drive the at least two first connecting rods to drive the at least two wind guide assemblies to rotate around the fixing bracket, parts of the at least two wind guide assemblies extending into the air outlet being opened or gathered relative to the air outlet to make the air outlet blow divergingly or concentratedly.

2. The blade adjustment mechanism according to claim 1, wherein one of the at least two wind guide assemblies comprises at least one wind deflector, one of a side edge of the at least one wind deflector located at the air outlet side and the fixing bracket defining a connection hole, the other one of the side edge of the at least one wind deflector located at the air outlet side and the fixing bracket comprising a rotation post, the rotation post being inserted into the connection hole to rotationally connect the at least one wind deflector and the fixing bracket.

3. The blade adjustment mechanism according to claim 1, wherein the second connecting rod defines a receiving part, and the blade adjustment mechanism further comprises:

an eccentric wheel assembly, comprising:

a wheel, movably received in the receiving part and abutted against a side wall of the receiving part; and an adjustment rod, connected to the wheel and extending from a surface of the wheel facing away from the receiving part;

wherein the adjustment rod is configured to be driven to rotate, and drive the second connecting rod to move closer to or farther away from the at least two wind guide assemblies.

4. The blade adjustment mechanism according to claim 2, wherein the at least one wind deflector comprises a blade extending into the air outlet, a side edge of the blade at the air inlet side being rotationally connected with one of the at least two first connecting rods, the blade being provided with the rotation post at an end;

wherein the connection hole is defined on the fixing bracket, the second connecting rod is configured to be driven to move closer to or farther away from the at least one wind deflector, the at least one wind deflector configured to drive the at least two first connecting rods, the at least two first connecting rods configured to cause the blade to rotate around a central axis of the connection hole, and cause the blade to be opened or gathered relative to the air outlet to make the air outlet blow divergingly or concentratedly.

5. The blade adjustment mechanism according to claim 2, wherein the second connecting rod defines a receiving part, and the blade adjustment mechanism further comprises:

an eccentric wheel assembly, comprising:

a wheel, movably received in the receiving part and abutted against a side wall of the receiving part; and an adjustment rod, connected to the wheel and extending from a surface of the wheel facing away from the receiving part;

wherein the adjustment rod is configured to be driven to rotate to drive the second connecting rod to move closer to or farther away from the at least two wind guide assemblies.

6. The blade adjustment mechanism according to claim 4, wherein one of a side end of the blade at the air inlet side and one of the at least two first connecting rods is provided with a limit post, the other one of the side end of the blade at the air inlet side and the one of the at least two first connecting rods defining a locking hole, the limit post being inserted into the locking hole to rotationally connect the one of the at least two first connecting rods and the blade.

7. The blade adjustment mechanism according to claim 6, wherein the housing comprises a partition plate provided at the air outlet and partitioning the at least two wind guide assemblies, and one of the at least two wind guide assemblies comprises at least two wind deflectors spaced apart from each other;

the blade adjustment mechanism further comprises a third connecting rod, one side of the third connecting rod being rotationally connected with one of the at least two first connecting rods, the other side of the third connecting rod defining at least two limit holes, the limit post being inserted and fixed to one of the at least two limit holes.

8. The blade adjustment mechanism according to claim 6, wherein the second connecting rod defines a receiving part, and the blade adjustment mechanism further comprises:

an eccentric wheel assembly, comprising:

a wheel, movably received in the receiving part and abutted against a side wall of the receiving part; and an adjustment rod, connected to the wheel and extending from a surface of the wheel facing away from the receiving part;

wherein the adjustment rod is configured to be driven to rotate to drive the second connecting rod to move closer to or farther away from the at least two wind guide assemblies.

9. The blade adjustment mechanism according to claim 7, wherein each of the at least two wind guide assemblies comprises a plurality of latches arranged at intervals on a side edge of the air inlet side of the air outlet, the fixing bracket comprising a plurality of fixing plates arranged at intervals along an extension direction of the air outlet, each of the plurality of fixing plates defining a plurality of limit slots arranged at intervals, each of the plurality of latches being configured to extend into one of the plurality of limit slots.

10. The blade adjustment mechanism according to claim 9, wherein the second connecting rod defines a receiving part, and the blade adjustment mechanism further comprises:

an eccentric wheel assembly, comprising:

a wheel, movably received in the receiving part and abutted against a side wall of the receiving part; and an adjustment rod, connected to the wheel and extending from a surface of the wheel facing away from the receiving part;

wherein the adjustment rod is configured to be driven to rotate to drive the second connecting rod to move closer to or farther away from the at least two wind guide assemblies.

11. The blade adjustment mechanism according to claim 10, wherein the eccentric wheel assembly further comprises a rod cap sleeved and fixed to an end of the adjustment rod facing away from the wheel.

12. The blade adjustment mechanism according to claim 10, wherein one of the second connecting rod and the fixing bracket defines a guide limit slot, the other one of the second connecting rod and the fixing bracket comprising a limit projection, the limit projection being configured to extend into the guide limit slot to limit movement of the second connecting rod relative to the fixing bracket.

13. An air circulator, comprising a housing, a cross-flow wind wheel and a blade adjustment mechanism adjacent to the cross-flow wind wheel, the cross-flow wind wheel being fixedly connected with the housing, the housing defining an air outlet, the air outlet comprising an air inlet side and an air outlet side, wherein the blade adjustment mechanism comprises:

a fixing bracket, fixedly connected with the housing;

at least two wind guide assemblies, spaced apart from each other and partially extending into the air outlet, one of the at least two wind guide assemblies comprising two opposite side edges, a side edge of the one of the at least two wind guide assemblies located at the air outlet side being rotationally connected with the fixing bracket;

at least two first connecting rods, an end of one of the at least two first connecting rods being rotationally connected with a side edge of the one of the at least two wind guide assemblies located at the air inlet side, extension lines of the at least two first connecting rods along length directions of the at least two first connecting rods being configured to intersect; and a second connecting rod, fixedly connected with an end of each of the at least two first connecting rods facing away from the at least two wind guide assemblies;

wherein the second connecting rod is configured to be driven to move closer to or farther away from the at least two wind guide assemblies to drive the at least two first connecting rods to drive the at least two wind guide assemblies to rotate around the fixing bracket, parts of the at least two wind guide assemblies extending into the air outlet being opened or gathered relative to the air outlet to make the air outlet blow divergingly or concentratedly.

14. The air circulator according to claim 13, wherein one of the at least two wind guide assemblies comprises at least one wind deflector, one of a side edge of the at least one wind deflector located at the air outlet side and the fixing bracket defining a connection hole, the other one of the side edge of the at least one wind deflector located at the air outlet side and the fixing bracket comprising a rotation post, the rotation post being inserted into the connection hole to rotationally connect the at least one wind deflector and the fixing bracket.

15. The air circulator according to claim 14, wherein one of the at least two wind guide assemblies comprises at least one wind deflector, one of a side edge of the at least one wind deflector located at the air outlet side and the fixing bracket defining a connection hole, the other one of the side edge of the at least one wind deflector located at the air outlet side and the fixing bracket comprising a rotation post, the rotation post being inserted into the connection hole to rotationally connect the at least one wind deflector and the fixing bracket.

16. The air circulator according to claim 15, wherein the at least one wind deflector comprises a blade extending into the air outlet, a side edge of the blade at the air inlet side being rotationally connected with one of the at least two first connecting rods, the blade being provided with the rotation post at an end;

wherein the connection hole is defined on the fixing bracket, the second connecting rod is configured to be driven to move closer to or farther away from the at least one wind deflector, the at least one wind deflector configured to drive the at least two first connecting rods, the at least two first connecting rods configured to cause the blade to rotate around a central axis of the connection hole, and cause the blade to be opened or gathered relative to the air outlet to make the air outlet blow divergingly or concentratedly.

17. The air circulator according to claim 13, wherein the second connecting rod defines a receiving part, and the blade adjustment mechanism further comprises:

an eccentric wheel assembly, comprising:

a wheel, movably received in the receiving part and abutted against a side wall of the receiving part; and an adjustment rod, connected to the wheel and extending from a surface of the wheel facing away from the receiving part;

wherein the adjustment rod is configured to be driven to rotate to drive the second connecting rod to move closer to or farther away from the at least two wind guide assemblies.

18. The air circulator according to claim 16, wherein one of a side end of the blade at the air inlet side and one of the at least two first connecting rods is provided with a limit post, the other one of the side end of the blade at the air inlet side and the one of the at least two first connecting rods defining a locking hole, the limit post being inserted into the locking hole to rotationally connect the one of the at least two first connecting rods and the blade.

19. The air circulator according to claim 18, wherein the housing comprises a partition plate provided at the air outlet and partitioning the at least two wind guide assemblies, and one of the at least two wind guide assemblies comprises at least two wind deflectors spaced apart from each other;

the blade adjustment mechanism further comprises a third connecting rod, one side of the third connecting rod being rotationally connected with one of the at least two first connecting rods, the other side of the third connecting rod defining at least two limit holes, the limit post being inserted and fixed to one of the at least two limit holes.

20. The air circulator according to claim 19, wherein each of the at least two wind guide assemblies comprises a plurality of latches arranged at intervals on a side edge of the air inlet side of the air outlet, the fixing bracket comprising a plurality of fixing plates arranged at intervals along an extension direction of the air outlet, each of the plurality of fixing plates defining a plurality of limit slots arranged at intervals, each of the plurality of latches being configured to extend into one of the plurality of limit slots.

* * * * *